US008800721B2

(12) United States Patent
Cortona et al.

(10) Patent No.: US 8,800,721 B2
(45) Date of Patent: Aug. 12, 2014

(54) ELEVATOR INSTALLATION

(75) Inventors: Elena Cortona, Zurich (CH); Frankie Schmid, Horw (CH)

(73) Assignee: Inventio AG, Hergiswil (CH)

( * ) Notice: Subject to any disclaimer, the term of this patent is extended or adjusted under 35 U.S.C. 154(b) by 356 days.

(21) Appl. No.: 13/280,827

(22) Filed: Oct. 25, 2011

(65) Prior Publication Data

US 2012/0097484 A1 Apr. 26, 2012

(30) Foreign Application Priority Data

Oct. 25, 2010 (EP) ..... 10188732

(51) Int. Cl.
*B66B 1/40* (2006.01)
*B66B 11/08* (2006.01)

(52) U.S. Cl.
USPC ..... 187/291; 187/257

(58) Field of Classification Search
CPC .. B66B 11/0095; B66B 1/40; B66B 11/0206; B66B 11/0213; B66B 11/022
USPC ..... 187/249, 257, 291
IPC ..... B66B 9/00, 11/08, 1/40
See application file for complete search history.

(56) References Cited

U.S. PATENT DOCUMENTS 1,805,227 A * 5/1931 Rugg ..... 187/249
2006/0163006 A1* 7/2006 Strebel et al. ..... 187/249
2006/0191747 A1* 8/2006 Mustalahti et al. ..... 187/249
2009/0301818 A1* 12/2009 Hashiguchi ..... 187/249
2011/0024239 A1* 2/2011 Kocher et al. ..... 187/249

FOREIGN PATENT DOCUMENTS

JP 2000309482 A 11/2000
JP 2001048447 A 2/2001
JP 2002302364 A 10/2002
JP 2007331871 A 12/2007

OTHER PUBLICATIONS

JP2002302364 English Translation.pdf.*

* cited by examiner

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

An elevator installation includes an elevator cage carrier movable in a travel space provided for travel of the elevator cage carrier. Moreover, a first elevator cage and a second elevator cage are adjustably arranged at the elevator cage carrier and a drive unit arranged at the elevator cage carrier. In addition, an adjusting device with a first traction means and a second traction means guided in opposite directions around a drive roller, drivable by the drive unit, is provided. In that case the spacing between the first elevator cage and the second elevator cage is adjustable by movement of the elevator cages in opposite directions. An adaptation to different story spacings is thereby possible.

16 Claims, 1 Drawing Sheet

ELEVATOR INSTALLATION

CROSS-REFERENCE TO RELATED APPLICATION

This application claims priority to European Patent Application No. 10188732.1, filed Oct. 25, 2010, which is incorporated herein by reference.

FIELD

The disclosure relates to an elevator installation with at least one elevator cage carrier, which can receive at least two elevator cages.

BACKGROUND

A double-decker elevator is known from JP 2007-331871 A. The known elevator comprises a cage frame in which two elevator cages are arranged vertically one above the other. In this regard the two elevator cages each stand on a respective carrier with cable rollers. In addition, provided at the cage frame is a drive unit around which a lifting cable is guided. The lifting cable is on the one hand guided around the cable rollers of the carrier for one elevator cage and on the other hand around the cable rollers of the carrier of the other elevator cage. Through actuation of the lifting cable by means of the drive unit the thus-suspended elevator cages can be raised and lowered relative to the cage frame. The two elevator cages can thereby be differently positioned within the cage frame.

The double-decker elevator known from JP 2007-331871 A can have the disadvantage that the drive unit, which is arranged at the cage frame, demands a relatively large amount of space. In this regard, the drive unit has to have a sufficient performance capability, since different traction forces can act on the lifting cable on the one hand with respect to one elevator cage and on the other hand with respect to the other elevator cage. This is possible, inter alia, due to different loading of the elevator cages. Moreover, high levels of force act on a drive pulley of the drive unit when the two elevator cages have maximum loading. Usually, the drive unit thus has to have a large performance capability in order to be able to accept the arising forces and moments and execute the desired adjustment movement even with maximum or extremely different levels of loading of the elevator cages.

SUMMARY

At least some embodiments comprise an elevator installation in which an adjustment of the elevator cages arranged at the elevator cage carrier is made possible and in which the demands on the drive unit are reduced.

In the design of the elevator installation the elevator cage carrier can be arranged in an elevator shaft, wherein a drive engine unit serving for actuation of the elevator cage carrier is provided. The elevator cage carrier can thereby be moved along the provided travel path. In this regard, the elevator cage carrier can be suspended at a traction means connected with the elevator cage carrier. The traction means can then be guided in suitable manner over a drive pulley of the drive engine unit. In that case, the traction means can also have the function, apart from the function of transmission of the force or the moment of the drive engine unit to the elevator cage carrier in order to actuate the elevator cage carrier, of supporting the elevator cage carrier. By actuation of the elevator cage carrier there is to be understood in this regard, in particular, raising or lowering of the elevator cage carrier in the elevator shaft. In that case, the elevator cage carrier can be guided by one or more guide rails in the elevator shaft.

The adjusting device serving for adjustment of the two elevator cages relative to the elevator cage carrier can also comprise, apart from the first traction means and the second traction means, further traction means. Specifically, several traction means can also be guided parallel to one another instead of a single first traction means. Correspondingly, several traction means can also be guided parallel to one another instead of a single second traction means. The traction means can be designed in the form of cables, belts or the like. In this regard, the traction means can also have the function, apart from the function of transmitting the drive force or the drive moment of the drive unit to the two elevator cages, of supporting the two elevator cages. In this case, one or more guide rails guiding the two elevator cages at the elevator cage carrier can also be constructed at the elevator cage carrier.

In further embodiments, the first traction means and the second traction means can be so guided in opposite directions around the drive roller driven by the drive unit that the drive roller and thus also an electric motor of the drive unit are loaded, at least substantially, by only a moment and transverse forces which arise are reduced or minimized. The design of the drive unit can thereby be simplified. In this regard, on actuation of the drive unit the spacing between the first elevator cage and the second elevator cage is adjustable by movement of the elevator cages in opposite directions.

The terms "roller" and "drive roller" are to be understood in a general sense. A roller or a drive roller can be formed by one or more parts. The roller or drive roller can also be designed in the form of a pulley, particularly as a drive pulley.

In particular embodiments, the first elevator cage is arranged below the second elevator cage. Possibly, the drive unit is arranged at the first elevator cage carrier, possibly fastened in stationary position at the elevator cage carrier. Moreover, in some embodiments the drive unit is arranged at a crossbeam of the elevator cage carrier. The drive unit can be arranged above the second elevator cage at the elevator cage carrier. For example, the crossbeam at which the drive unit is arranged can be positioned above the two elevator cages. As a result, deflection of the two traction means to the drive roller of the drive unit can result.

In additional embodiments, the first elevator cage has a first longitudinal side and a second longitudinal side remote from the first longitudinal side, the second elevator cage has a first longitudinal side and a second longitudinal side remote from the first longitudinal side, the first traction means on the one hand is guided between the drive roller and the first end of the traction means along the first longitudinal side of the second elevator cage past the second elevator cage to the first elevator cage, and the second traction means on the other hand is guided between the drive roller and the second end of the second traction means along the second longitudinal side of the second elevator cage past the second elevator cage to the first elevator cage. A compact cable guidance can thereby be made possible.

In further embodiments, the first traction means on the one hand is guided between the drive roller and the first end of the first traction means at least in a section along the first longitudinal side of the first elevator cage, and/or the second traction means on the other hand is guided between the drive roller and the second end of the second traction means at least in a section along the second longitudinal side of the first elevator cage. Moreover, in some cases the second traction means on the one hand is guided between the drive roller and the first end of the second traction means, at least in a section along the first longitudinal side of the second elevator cage, and/or the first traction means on the other hand is guided between the drive roller and the second end of the first traction means, at least in a section along the second longitudinal side of the second elevator cage. The two traction means can thereby be guided along the two elevator cages. The space provided for the elevator cages within the elevator cage carrier can thereby be utilized for the two elevator cages. The cross-section available in the elevator cage can also thereby be utilized.

Moreover, in further embodiments the first end of the first traction means is connected with the first elevator cage in the region of an underside of the first elevator cage, and/or the second end of first traction means is connected with the second elevator cage in the region of an underside of the second elevator cage, and/or the first end of the second traction means is connected with the second elevator cage in the region of the underside of the second elevator cage, and/or the second end of the second traction means is connected with the first elevator cage in the region of the underside of the first elevator cage. A fastening of the two traction means to the two elevator cages can thereby be possible. Moreover, this fastening can enable a relatively close guidance of the two traction means along the two elevator cages, whereby a compact design can result.

In further embodiments it is also possible to connect the first end of the first traction means with the first elevator cage in the region of an upper side of the first elevator cage, and/or to connect the second end of the first traction means with the second elevator cage in the region of an upper side of the second elevator cage, and/or to connect the first end of the second traction means with a second elevator cage in the region of the upper side of the second elevator cage, and/or to connect the second end of the second traction means with the first elevator cage in the region of the upper side of the first elevator cage. By comparison with the previously described fastening, it can be possible to use particularly short traction means.

In additional embodiments, the adjusting device on the one hand comprises a first roller arrangement, the first traction means on the one hand is guided between the driver roller and the first end of the first traction means by way of a first roller of the first roller arrangement, the second traction means on the other hand is guided between the drive roller and the first end of the second traction means by way of a second roller of the first roller arrangement, the adjusting device on the other hand comprises a second roller arrangement, the first traction means on the other hand is guided between the drive roller and the second end of the first traction means by way of a first roller of the second roller arrangement, and the second traction means on the other hand is guided between the drive roller and the second end of the second traction means by way of a second roller of the second roller arrangement. In this regard, the first roller arrangement and the second roller arrangement can be arranged at the crossbeam of the elevator cage carrier at which the drive unit is also fastened. In that case, the drive unit can be arranged between the two roller arrangements. A guidance of the two traction means can thereby be achieved, wherein the two traction means are guided in opposite directions relative to one another around the drive roller. The drive roller and thus the drive unit can in that regard be relieved of forces which arise.

In some embodiments, the first roller of the first roller arrangement and the second roller of the first roller arrangement rotate in opposite directions relative to one another on actuation of the first traction means and the second traction means by way of the drive roller driven by the drive unit. Moreover, in further embodiments the first roller of the second roller arrangement and the second roller of the second roller arrangement rotate in opposite directions relative to one another on actuation of the first traction means and the second traction means by way of the drive roller driven by the drive unit. In additional embodiments, the first roller of the first roller arrangement and the first roller of the second roller arrangement rotate in opposite directions relative to one another on actuation of the first traction means and the second traction means by way of the drive roller driven by the drive unit. Moreover, in further embodiments the second roller of the first roller arrangement and the second roller of the second roller arrangement rotate in opposite directions relative to one another on actuation of a first traction means and the second traction means by way of the drive roller driven by way of the drive unit. In this regard, the first roller and the second roller of the first roller arrangement can, for example, be mounted on a common axle. Moreover, the first roller and the second roller of the second roller arrangement can also be mounted on a common axle. The two traction means can thereby be guided independently of one another by way of the two roller arrangements. Depending on the rotational direction of the drive roller driven by the drive unit the two traction means can then run in opposite directions to one another over the first roller arrangement or the second roller arrangement. A suspension of the two elevator cages at the two traction means can thus be made possible. Specifically, an equalization of forces can result.

In some cases, the first traction means is guided from above around the drive roller and the second traction means is guided from below around the drive roller. In other cases, the second traction means is guided from above around the drive roller and the first traction means is guided from below around the drive roller. As a result, driving of the two traction means in opposite directions can be carried out. The two traction means are in that case guided in opposite directions around the drive roller.

In other embodiments, a further adjusting device is provided, wherein the further adjusting device comprises a further drive roller arranged at the elevator cage carrier, a third traction means guided around the further drive roller and a fourth traction means guided around the further drive roller in opposite directions to third traction means, wherein a first end of the third traction means of the further adjusting device is connected at least indirectly with the first elevator cage, wherein a second end of the third traction means of the further adjusting device is connected at least indirectly with the second elevator cage, wherein a first end of the fourth traction means of the further adjusting device is connected at least indirectly with the second elevator cage, wherein a second end of the fourth traction means of the further adjusting device is connected at least indirectly with the first elevator cage and wherein the further drive roller of the further adjusting device is driven correspondingly to the drive roller of the adjusting device.

The further drive roller of the further adjusting device can be driven by the drive unit of the adjusting device. A drive unit can thereby serve for actuation of the two adjusting devices. A suspension of the two elevator cages in the elevator cage carrier can be achieved by the further adjusting device.

BRIEF DESCRIPTION OF THE DRAWING

Exemplifying embodiments of the disclosed technologies are explained in more detail in the following description by way of the accompanying drawing, in which.

DETAILED DESCRIPTION

Figure 1:
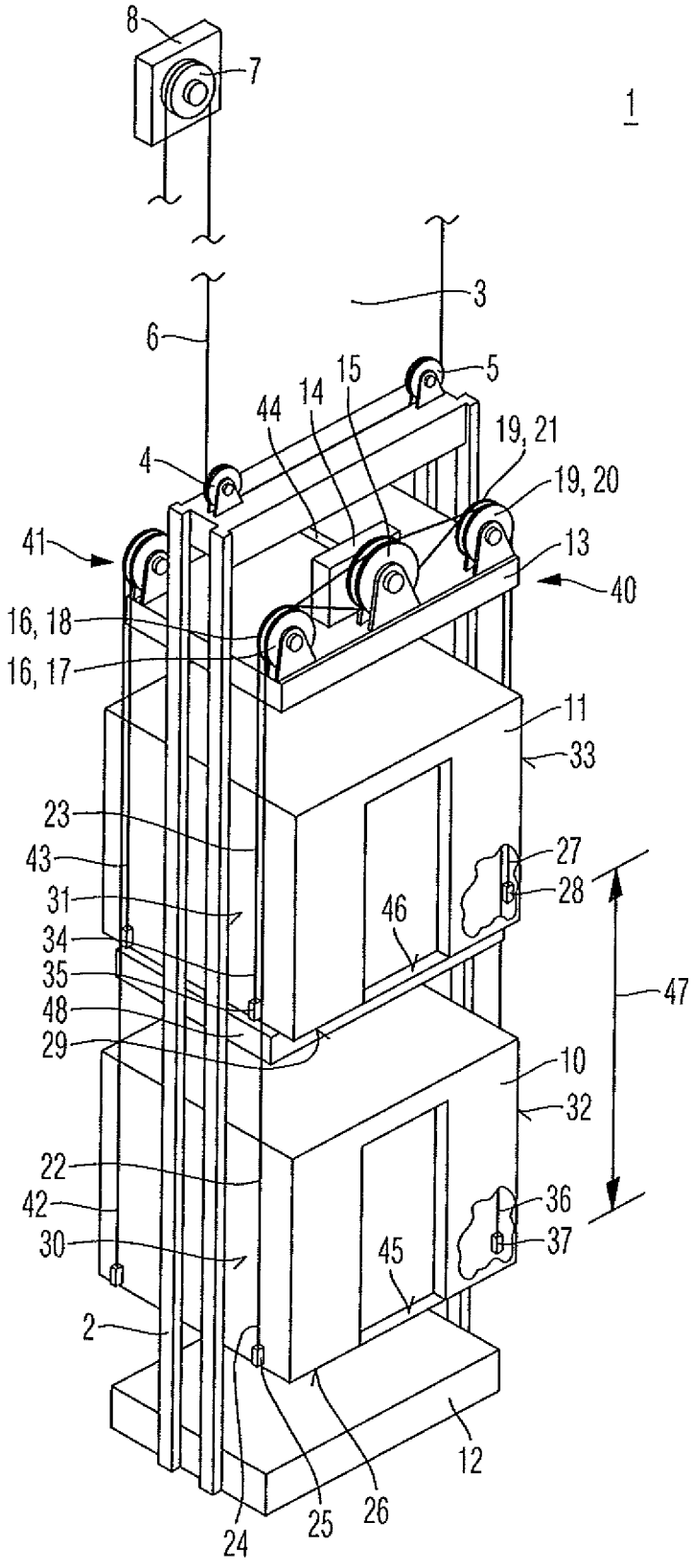
FIG. 1 shows an exemplary embodiment of an elevator installation.

FIG. 1 shows an elevator installation 1 with at least one elevator cage carrier 2, which is movable in a travel space 3 provided for travel of the elevator cage carrier 2. The travel space 3 can, for example, be provided in an elevator shaft of a building.

The elevator cage carrier 2 is suspended at a traction means 6 by way of cable rollers 4, 5. Alternatively, the elevator cage carrier 2 can also be suspended at the traction means 6 by way of a single centrally arranged cable roller. The traction means 6 is, in addition, guided over a drive pulley 7 of a drive engine unit 8. The drive engine unit 8 is in this connection arranged in the elevator shaft. The elevator cage carrier 2 is moved upwardly or downwardly through the travel space 3 in correspondence with an instantaneous direction of rotation of the drive pulley 7.

A first elevator cage 10 and a second elevator cage 11 are adjustably arranged at the elevator cage carrier 2. In this regard, the first elevator cage 10 is arranged below the second elevator cage 11. The elevator cage carrier 2 comprises a lower crossbeam 12 and an upper crossbeam 13. The upper crossbeam 13 is in that case arranged in stationary position at the elevator cage carrier 2. A drive unit 14 for driving a drive roller 15 is fastened to the upper crossbeam 13. The drive unit 14 together with the drive roller 15 is thus arranged at the upper crossbeam 13 above the second elevator cage 11.

In addition, a first roller arrangement 16 with a first roller 17 and a second roller 18 is arranged at the upper crossbeam 13. Moreover, a second roller arrangement 19 with a first roller 20 and a second roller 21 is arranged at the upper crossbeam 13. The drive roller 15 of the drive unit 14 is disposed between the first roller arrangement 16 and the second roller arrangement 19.

Furthermore, a first traction means 22 and a second traction means 23 are arranged at the elevator cage carrier 2. In this regard, a first end 24 of the first traction means 22 is connected with the first elevator cage 10 at a fastening point 25 in the region of an underside 26 of the first elevator cage 10. Further, a second end 27 of the first traction means 22 is connected with the second elevator cage 11 at a fastening point 28 in the region of an underside 29 of the second elevator cage 11. The first traction means 22 is in this regard guided on the one hand by way of the first roller 17 of the first roller arrangement 16. On the other hand, the first traction means 22 is guided by way of the first roller 20 of the second roller arrangement 19. Between the first roller 17 of the first roller arrangement 16 and the first roller 20 of the second roller arrangement 19 the first traction means 20 is guided from above over the drive roller 15. Moreover, the first traction means 22 is guided along a first longitudinal side 30 of the first elevator cage 10 and along a first longitudinal side 31 of the second elevator cage 11 past not only the first elevator cage 10, but also the second elevator cage 11. The first elevator cage 10 also has a second longitudinal side 32 remote from the first longitudinal side 30. In addition, the second elevator cage 11 has a second longitudinal side 33 remote from the first longitudinal side 31. The first traction means 22 is guided along the second longitudinal side 33 of the second elevator cage 11 past the second elevator cage 11 to the fastening point 28.

A first end 34 of the second traction means 23 is connected with the second elevator cage 11 at a fastening point 35 in the region of the underside 29. Moreover, a second end 36 of the second traction means 23 is connected with the first elevator cage 10 at a fastening point 37 in the region of the underside 26. The second traction means 23 is on the one hand guided by way of the second roller 18 of the first roller arrangement 16 and on the other hand by way of the second roller 21 of the second roller arrangement 19. Between the second roller 18 of the first roller arrangement 16 and the second roller 21 of the second roller arrangement 19 the second traction means 23 is guided from below around the drive roller 15. Moreover, the second traction means 23 is guided on the one hand along the first longitudinal side 31 of the second elevator cage 11 past the second elevator cage 11. On the other hand the second traction means 23 is guided along the second longitudinal side 33 of the second elevator cage 11 past the second elevator cage 11 and along the second longitudinal side 32 of the first elevator cage 10 past the first elevator cage 10 to the fastening point 37.

The first elevator cage 10 and the second elevator cage 11 are suspended in advantageous manner within the elevator cage carrier 2 by way of the traction means 22, 23. In this regard, the first traction means 22 and the second traction means 23 are guided in opposite directions at least once around the drive roller 15. On actuation of the drive roller 15 by the drive unit 14 the first traction means 22 and the second traction means 23 run in opposite directions past one another. In that case the first roller 17 and the second roller 18 of the first roller arrangement 16 rotate in opposite directions to one another. Furthermore, the first roller 20 and the second roller 21 of the second roller arrangement 19 in that case also rotate in opposite directions to one another.

An adjusting device 40 is thus constructed, which serves for adjustment of the two elevator cages 10, 11 relative to the elevator cage carrier 2 and relative to one another. The adjusting device 40 comprises the drive roller 15 drivable by the drive unit 14, the first roller arrangement 16 with the first roller 17 and the second roller 18, the second roller arrangement 19 with the first roller 20 and the second roller 21 as well as the first traction means 22 and the second traction means 23.

The first elevator cage 10 has a disembarkation level 45. Further, the second elevator cage 11 has a disembarkation level 46. The disembarkation levels 45, 46 have a spacing 47 from one another. The spacing 47 between the elevator cages 10, 11 can be varied by way of the drive unit 14 and the adjusting device 40. Depending on the rotational direction of the drive roller 15 in that case the spacing 47 is enlarged or reduced within certain limits. For example, a story spacing can vary within a building. In particular, a story spacing with respect to a lobby can be greater than an otherwise provided story spacing. For example, the spacing 47 between the elevator cages 10, 11 can be increased, starting from a minimum spacing 47, by up to 3 meters.

In the initial state illustrated in FIG. 1, the underside 29 of the second elevator cage 11 is located in the region of a middle crossbeam 48 of the elevator cage carrier 2. A further lowering of the second elevator cage 11 relative to the elevator cage carrier 2 is therefore not possible. The illustrated spacing 47 therefore indicates a predetermined minimum spacing 47. In this regard, the minimum spacing 47 can be set within certain limits by way of the length of the traction means 22, 23.

For raising the second elevator cage 11 relative to the elevator cage carrier 2 the drive roller 15 is driven by the drive unit 14. In this exemplifying embodiment, for raising the second elevator cage 11 a driving of the drive roller 15 in counter-clockwise direction is required. The part of the second traction means 23, which is on the one hand located between the first roller arrangement 16 and the fastening point 35, thereby shortens. In that case, a corresponding lengthening of the part of the second traction means 23, which on the other hand is located between the second roller arrangement 19 and the fastening point 37, takes place. Since the traction means 22, 23 are guided in opposite directions around the drive roller 15, the effect with respect to the first traction means 22 is directly opposite. The first traction means 22, in particular, runs oppositely to the second traction means 23. Thus, the part of the first traction means 22, which is located on the one hand between the first roller arrangement 16 and the second fastening point 25 lengthens. Correspondingly, a shortening of the part of the first traction means 22, which on the other hand is located between the second roller arrangement 19 and the fastening point 28, takes place.

As a result, the first elevator cage 10 is lowered from the starting position illustrated in FIG. 1, whilst the second elevator cage 11 is raised from the starting position illustrated in FIG. 1. The spacing 47 between the first elevator cage 10 and the second elevator cage 11 thereby increases. Moreover, an adjustment travel of the first elevator cage 10 is at least approximately the same size as an adjustment travel of the second elevator cage 11. Moreover, the two elevator cages 10, 11 are adjusted relative to one another in opposite directions. In the case of an increase in the spacing 47, the first elevator cage 10 is, in particular, adjusted downwardly and the second elevator cage 11 adjusted upwardly.

Conversely, in the case of driving of the drive roller 15 in opposite direction, i.e. in clockwise direction, a lowering of the second elevator cage 11 occurs, whilst the first elevator cage 10 is raised. The spacing 47 can thereby be further shortened.

A variation of the spacing 47 by actuation of the drive roller 15 by means of the drive unit 14 can thus take place within certain limits. An adaptation 47 to the respective story spacing of the destination stories is thereby made possible.

The first traction means 22 and the second traction means 23 are acted on at the drive roller 15 by tension forces. Such tension forces result from, for example, the weight forces of the elevator cages 10, 11. In this regard, a force equalization between the weight forces of the two elevator cages 10, 11 comes about. The one elevator cage 10 then acts as a counterweight of the other elevator cage 11. The drive roller 15 thus, at least substantially, only has to exert on the traction means 22, 23 a torque, which is sufficient in order to overcome the unbalanced weight force between the two elevator cages 10, 11 as well as friction forces in the system.

The traction means 22, 23 can also be respectively guided completely around the drive roller 15. Specifically, the first traction means 22 can be guided through at least 360° around the drive roller 15. Correspondingly, the second traction means 23 can also be guided through at least 360° around the drive roller 15. A good friction couple between each of the traction means 22, 23 and the drive roller 15 can thereby be achieved. Slip between the traction means 22, 23 and the drive roller 15 can thus be prevented.

The drive unit 14 can drive the drive roller 15 by way of a worm gear. The drive unit 14 is then connected by way of a worm gear with the drive roller 15. Small movements of the traction means 22, 23 can thereby be achieved. Small actuation paths of the elevator cages 10, 11 for changing the spacing 47 can thus be achieved. Specifically, the drive unit 14 with the drive roller 15 can thereby be so designed that in the case of a normal rotational speed of the drive unit 14 small adjusting movements of the elevator cages 10, 11 relative to the elevator cage carrier 2 are also possible. In this manner, a 1:1 adjustment by the adjusting device 40 can also be made possible in which a small loss friction occurs and relatively short traction means 22, 23 suffice.

The drive unit 14 can thus be designed to be relatively small and have an optimized performance capability. In this regard, in relation to the performance capability of the drive unit 14 relative large adjustment paths between the two elevator cages 10, 11, particularly of two or more meters, can be realized.

For example, a 1:1 suspension can be realized, which is actuated by a small motor of the drive unit 14. For example, the power of the drive unit 14 can lie in the range of 2 kilowatts to 5 kilowatts. As a result, for example, elevator cages 10, 11 can be actuated, which each have a mass of 2,250 kilograms. A larger range of use for the elevator installation 1 thus results.

Alternatively, higher suspension ratios of 2:1, 3:1 or more can be realized.

In addition, a further adjusting device 41 can be provided. The further adjusting device 41 can be designed substantially in correspondence with the adjusting device 40 and have substantially the same function, as described previously for the adjusting device 40, for setting the spacing 47 between the elevator cages 10, 11. In particular, a third traction means 42 and a fourth traction means 43 as well as a further drive roller, which is not illustrated in FIG. 1 and is concealed by the elevator cage carrier 2, can be provided. In that case, the traction means 42, 43 are in operative contact with the further drive roller. In that regard, a connecting shaft 44 of the drive unit 14 can connect with the further adjusting device 41. The drive unit 14 can thereby serve for driving not only the components of the adjusting device, but also the components of the further adjusting device 41. Actuation of not only the first traction means 22 and the second traction means 23 of the adjusting device 40, but also of the third traction means 42 and the fourth traction means 43 of the further adjusting device 41 can thus be effected by way of the drive unit 14.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator installation comprising:

an elevator cage carrier movable in a travel space;

a first elevator cage adjustably arranged in the elevator cage carrier;

a second elevator cage adjustably arranged in the elevator cage carrier;

a drive unit arranged at the elevator cage carrier; and an adjusting device comprising a first traction device and a second traction device, the first and second traction devices being guided to run in opposite directions by a drive roller, the drive roller driven by the drive unit for adjusting a spacing between the first and second elevator cages by moving the first and second elevator cages in opposite directions, wherein the first elevator cage has a first longitudinal side and a second longitudinal side remote from the first longitudinal side, wherein the second elevator cage has a first longitudinal side and a second longitudinal side remote from the first longitudinal side of the second elevator cage, wherein the first traction device has a first end connected with the first elevator cage and a second end connected with the second elevator cage, wherein the second traction device has a first end connected with the second elevator cage and a second end connected with the first elevator cage, and wherein the first traction device is guided from the first end of the first traction device along the first longitudinal side of the first elevator cage, past the first longitudinal side of the second elevator cage, along the drive roller and along the second longitudinal side of the second elevator cage to the second end of the first traction device.

2. The elevator installation of claim 1, the first and second elevator cages being adjustable in opposite adjustment directions by the drive unit, an adjustment distance of the first elevator cage relative to the elevator cage carrier being approximately equal to an adjustment distance of the second elevator cage relative to the elevator cage carrier.

3. The elevator installation of claim 1, the second traction device running from the first end along the first longitudinal side of the second elevator cage, along the drive roller and past the second longitudinal side of the second elevator cage, and along the second longitudinal side of the first elevator cage to the second end of the second traction device.

4. The elevator installation of claim 1, the first end of the first traction device being connected to the first elevator cage adjacent an underside of the first elevator cage.

5. The elevator installation of claim 1, the second end of the first traction device being connected to the second elevator cage adjacent an underside of the second elevator cage.

6. The elevator installation of claim 1, the first end of the second traction device being connected to the second elevator cage adjacent an underside of the second elevator cage.

7. The elevator installation of claim 1, the second end of the second traction device being connected to the first elevator cage adjacent an underside of the first elevator cage.

8. The elevator installation of claim 1, the adjusting device comprising first and second roller arrangements, the first and second roller arrangements each comprising respective first and second rollers, the first traction device running along the first roller of the first roller arrangement and the first roller of the second roller arrangement, and the second traction device running along the second roller of the first roller arrangement and the second roller of the second roller arrangement.

9. The elevator installation of claim 8, the first and second rollers of the first roller arrangement being configured to rotate in opposite directions when the drive roller acts on the first and second traction devices, and the first and second rollers of the second roller arrangement being configured to rotate in opposite directions when the drive roller acts on the first and second traction devices.

10. The elevator installation of claim 1, the first traction device being guided from above around the drive roller and the second traction device being guided from below around the drive roller.

11. The elevator installation of claim 1, the adjusting device being a first adjusting device, the installation further comprising:

a third traction device;

a fourth traction device;

a second adjusting device, the second adjusting device comprising a drive roller arranged at the elevator cage carrier, the third and fourth traction devices being guided around the drive roller of the second adjusting device in opposite directions.

12. The elevator installation of claim 11, a first end of the third traction device being connected to the first elevator cage, a second end of the third traction device being connected to the second elevator cage, a first end of the fourth traction device being connected to the second elevator cage, a second end of the fourth traction device being connected to the first elevator cage, and the drive roller of the first adjusting device being configured to drive correspondingly to the drive roller of the second adjusting device.

13. The elevator installation of claim 11, the third and fourth traction devices passing at least completely around the drive roller of the second adjusting device.

14. The elevator installation of claim 1, the drive roller having an axis of rotation around which the first and second traction devices are guided.

15. The elevator installation of claim 1, the first and second traction devices passing at least completely around the drive roller.

16. The elevator installation of claim 1 wherein the drive roller rotates on an axis perpendicular to the directions in which the first and second elevator cages move.

* * * * *